US008905720B2

(12) United States Patent
Almå et al.

(10) Patent No.: US 8,905,720 B2
(45) Date of Patent: Dec. 9, 2014

(54) ARRANGEMENT AND METHOD FOR MONITORING A HYDRAULIC SYSTEM

(75) Inventors: Jüri Almå, Linköping (SE); Magnus Landberg, Linköping (SE); Mats Kristoffersson, Linköping (SE)

(73) Assignee: SAAB AB, Linköping (SE)

( * ) Notice: Subject to any disclaimer, the term of this patent is extended or adjusted under 35 U.S.C. 154(b) by 1413 days.

(21) Appl. No.: 12/149,573

(22) Filed: May 5, 2008

(65) Prior Publication Data

US 2008/0286119 A1 Nov. 20, 2008

(30) Foreign Application Priority Data

May 4, 2007 (EP) ..... 07107569

(51) Int. Cl.
*F04B 49/08* (2006.01)
*F04B 51/00* (2006.01)

(52) U.S. Cl.
CPC ..... *F04B 51/00* (2013.01); *F04B 2205/06* (2013.01); *F04B 2205/09* (2013.01)
USPC ..... 417/43; 417/44.2; 417/53

(58) Field of Classification Search
CPC ..... F04B 49/08; F04B 49/022
USPC ..... 417/43, 53; 73/168, 196; 702/138, 100, 702/98
See application file for complete search history.

(56) References Cited

U.S. PATENT DOCUMENTS 4,938,663 A * 7/1990 Mitsuhashi et al. ..... 417/44.4
5,772,403 A * 6/1998 Allison et al. ..... 417/44.2
6,132,012 A * 10/2000 Ishii ..... 303/122.12
6,343,614 B1 2/2002 Gray et al.
6,389,901 B1 * 5/2002 Joos et al. ..... 73/714
2005/0262838 A1 12/2005 Kageyama et al.
2007/0093753 A1 * 4/2007 Krulevitch et al. ..... 604/131
2008/0302111 A1 * 12/2008 Batenburg et al. ..... 62/50.6

FOREIGN PATENT DOCUMENTS

DE 10334817 A1 3/2005
EP 1674365 A 6/2006

OTHER PUBLICATIONS

European Search Report—Oct. 23, 2007.

* cited by examiner

*Primary Examiner* — Christopher Bobish
(74) *Attorney, Agent, or Firm* — Venable LLP; Eric J. Franklin

(57) ABSTRACT

An arrangement for monitoring a supply within a platform. A sensor is arranged to generate sample values relating to a fluid characteristic variable, wherein the fluid is fed by the supply within the platform. A processor is arranged to receive a plurality of sample values from the sensor. The processor, is arranged to generate an absolute value of a difference between each of the received plurality of sample values and a subsequent associated sample value, wherein the received sample values are generated during a predetermined time period. The processor is arranged to determine an indication number corresponding to the number of the generated absolute values which are greater than a predetermined threshold value. The sample collecting process is only active when a criterion comprising a stable pump in a no load condition and all hydraulic consumers are in a resting position or close to a resting position is fulfilled. The processor is arranged to generate a piece of indication information depending upon a result of a comparison between the determined indication number and a predetermined comparison value.

16 Claims, 8 Drawing Sheets

ARRANGEMENT AND METHOD FOR MONITORING A HYDRAULIC SYSTEM

CROSS-REFERENCE TO RELATED APPLICATIONS

This application claims priority to European patent application 07107569.1 filed May 2007.

TECHNICAL FIELD

The invention relates in general to monitoring of hydraulic pumps. In particular the invention relates to monitoring of hydraulic pumps provided within a platform.

The invention also relates to a method for monitoring hydraulic pumps. In particular the invention relates to a method for monitoring hydraulic pumps within a platform. Furthermore, the invention relates to software adapted to perform steps of the monitoring method, when executed on a computer.

BACKGROUND OF THE INVENTION

It is known that vital functions of different platforms are controlled by means of hydraulic systems. For example, in the field of aviation, airplanes are provided with at least one hydraulic system being used for controlling e.g. control surfaces, landing gears or air brakes. It is common to have two separate, independent hydraulic systems, so as to provide redundancy. Each hydraulic system is associated with a hydraulic pump powered by for example a motor of the platform via a gear box.

In aircrafts, in particular during flights, it is of outmost importance that provided hydraulic pumps function properly. A failing hydraulic pump is hazardous, even if a back-up hydraulic system is provided within the platform.

Today there exist various methods relating to monitoring of hydraulic systems. For example, the document DE 10334817 depicts a device for monitoring of a pump. The pump is provided with a pressure sensor arranged to measure the pressure of the pump. Detected pressure data is sampled and subsequently Fourier-transformed.

EP 1674365 discloses a device for monitoring a pump, for example arranged for a vehicle brake. Detected pressure data is sampled and subsequently Fourier-transformed. Frequencies of pressure pulsations are compared with reference frequencies of a properly functioning pump.

Both DE 10334817 and EP 1674365 involve Fourier-transformation which is associated with a heavy computational burden.

It therefore exist a need to provide an arrangement capable to detect malfunctioning hydraulic pumps at an early stage within a platform, such as an airplane, while minimizing computational burden.

SUMMARY OF THE INVENTION

An object of the invention according to an aspect of the invention is to provide an improved arrangement and method for monitoring of a hydraulic pump.

Another object of the invention according to an aspect of the invention is to provide an arrangement and method for detecting a malfunctioning hydraulic pump at an early stage.

Yet another object of the invention according to an aspect of the invention is to provide an arrangement and method for detecting a malfunctioning hydraulic pump while reducing the computational burden.

Yet another object of the invention according to an aspect of the invention is to achieve a robust and reliant arrangement and method for detecting a malfunctioning hydraulic pump at an early stage.

Above mentioned problems are solved by an arrangement for monitoring a supply means within a platform, the arrangement comprising:

sensor means being arranged to generate sample values relating to a fluid characteristic variable, wherein said fluid is fed by the supply means within the platform;

processing means being arranged to receive a plurality of sample values from said sensor means, wherein the processing means is arranged to generate an absolute value of a difference between each of said received plurality of sample values and a respective associated sample value, wherein said received sample values are generated during a predetermined time period, and the processing means is arranged to determine an indication number corresponding to the number of said generated absolute values which are greater than a predetermined threshold value, wherein the processing means is arranged to generate a piece of indication information depending upon a result of a comparison between said determined indication number and a predetermined comparison value.

Preferably the supply means is a hydraulic pump, such as a hydraulic pump. Preferably the fluid is a hydraulic fluid.

Preferably the fluid characteristic variable is a hydraulic fluid characteristic variable chosen from a group comprising hydraulic fluid pressure and a hydraulic fluid flow. Preferably the respective associated sample value is a subsequent sample value.

Preferably the processing means is arranged to store the piece of indication information in a memory so as to allow a user to access said indication information.

Preferably the piece of indication information comprising information about a state of condition of said supply means.

Preferably the information about a state of condition comprises information about that the supply means is malfunctioning.

Preferably the indication means is arranged to generate a fault report after a predetermined time or substantially instantaneous depending upon a result of the comparison between said determined indication number and a predetermined comparison value.

The invention also relates to a platform comprising above mentioned arrangement. Preferably the platform is an aircraft, e.g. an airplane. Alternatively, the platform is a ground vehicle, water craft or underwater craft, automobile, ship or submarine.

According to an aspect of the invention the number of hydraulic variable data, such as pressure samples, whose amplitude differs from a magnitude of a preceding hydraulic variable data more than a predetermined value (aperture), within a time window, is registered. The number of counted hydraulic variable data according to the given criterion is compared with a predetermined number (set value). An indication of a malfunctioning pump is generated if the number of registered hydraulic variable data is larger than or equal to the predetermined number (set value). Thus the model according to the invention is based upon statistics.

The arrangement for monitoring the hydraulic pump is active during a stand-by state of condition, i.e. a state of rest. In other words, a state where sub-systems of the hydraulic system of the platform only require a hydraulic fluid flow which is insignificantly larger than a leakage flow within a respective hydraulic consumer. Monitoring during a state of rest, for example during taxation of an airplane on ground before take-off or during cruise, is a convenient and safe implementation of the invention.

One positive outcome of the arrangement and method according to the invention is that no extra hardware components are needed to be installed in aircrafts of today. Existing sensors and data processing units may be used for realising the invention.

The solution according to the invention is not based on analysis of frequency domain and therefore refers to another methodology. Fast Fourier Transform (FFT) analysis is not required to achieve an early indication of a malfunctioning hydraulic pump.

Advantageously the method and system according to the invention does not require continuously high sample frequencies, which is required in FFT-implementations according to prior art. Further, method according to the invention does not require pressure sensors providing high break frequency. Even further, the method and system does not require time equidistant samples for further processing, so as to monitor a hydraulic system.

It should be noted that there is required a small amount of data samples, and a minimum of variables to successfully monitor a hydraulic pump according to the invention.

Advantageously program code comprising routines for monitoring a hydraulic system easily can be implemented in platforms of today, thus providing a cheap and efficient upgrading possibility of a platform fleet.

The invention can advantageously be implemented for both main hydraulic pumps and back-up hydraulic pumps.

Preferably the method of monitoring a hydraulic pump is performed on-line. Preferably the method of monitoring a hydraulic pump is performed on-line on-board the platform.

The present invention further provides an improved ability to early detect a malfunctioning individual pump, which reduces the risk for pump breakdown in air or during driving of the platform. Improved safety of platforms is highly desirable, not at least for the operators thereof.

A beneficial contribution of the invention is that a cost effective solution to the above stated problems is achieved. Expensive hardware replacements implied by pump failures are avoided or reduced. Further, maintenance of the platform is facilitated and the availability of the platform is highly increased, which also contribute to lower overall costs of the platform. Replacement of failured pump can also be done during scheduled maintenance.

Yet another beneficial contribution of the invention is that the system and method for monitoring the hydraulic pump is robust, meaning that false alarms are reduced, which also reduces the stress for the operator of the platform.

The invention can be retro modified in existing aircraft fleet, which in some cases has very simple computer systems with limited CPU and memory capacities. This benefit opens up for a big civil market in the field of health monitoring.

According to an aspect of the invention there is provided a device at a hydraulic pump arranged to detect malfunctioning of the pump, wherein the device comprises:

calculating means arranged to, during a predetermined time interval, determine a number of samples, of which amplitude differ more than a first predetermined value from the amplitude of a preceding sample, and if the number of established number of samples exceeds a second predetermined value there is detected that the pump is malfunctioning.

Preferably the samples are pressure samples.

According to an aspect of the invention there is provided a control unit arranged to control activation of the aforementioned device so that activation only is possible when pump operation is in a stand-by state, or an idle state.

Additional objects, advantages and novel features of the present invention will become apparent to those skilled in the art from the following details, as well as by practice of the invention. While the invention is described below, it should be understood that the invention is not limited to the specific details disclosed. A person skilled in the art having access to the teachings herein will recognise additional applications, modifications and embodiments in other fields, which are within the scope of the invention.

BRIEF DESCRIPTION OF THE DRAWINGS

For a more complete understanding of the present invention and further objects and advantages thereof, reference is now made to the examples shown in the accompanying drawings, in which.

DETAILED DESCRIPTION OF THE DRAWINGS

Figure 1A:
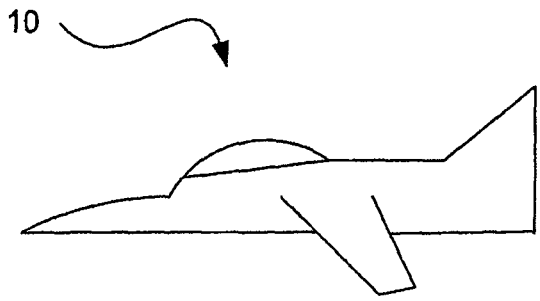
FIG. 1*a* schematically illustrates a platform according to an aspect of the present invention.

With reference to FIG. 1*a* a platform 10 is schematically shown. The platform may be an airplane, such as a passenger traffic airplane. Alternatively the airplane can be a military aircraft, such as a fighter, bomber, reconnaissance airplane, or a combination thereof. The platform may also be an autonomous platform, such as an unmanned aerial vehicle (UAV). The autonomous platform can also be any kind of a helicopter, robot or missile.

Herein, for sake of simplicity, the arrangement and method for monitoring of a hydraulic system according to the invention is depicted for the case of the platform being an airplane controlled by a pilot. However, various different applications of the arrangement are possible, e.g. for use of remote controlled vehicles such as helicopters.

It should be noted that the platform 10 alternatively can be a ground vehicle, water craft or underwater craft, e.g. an automobile, ship or submarine. Alternatively, the platform 10 can be a space craft. The platform 10 comprises a sub-system, which is depicted in greater detail below with reference to FIG. 1*b*.

Hereinafter the term "link" refers to a communication link which may be a physical connector, such as an optoelectronic communication wire, or a non-physical connector such as a wireless connection, for example a radio or microwave link.

Figure 1B:
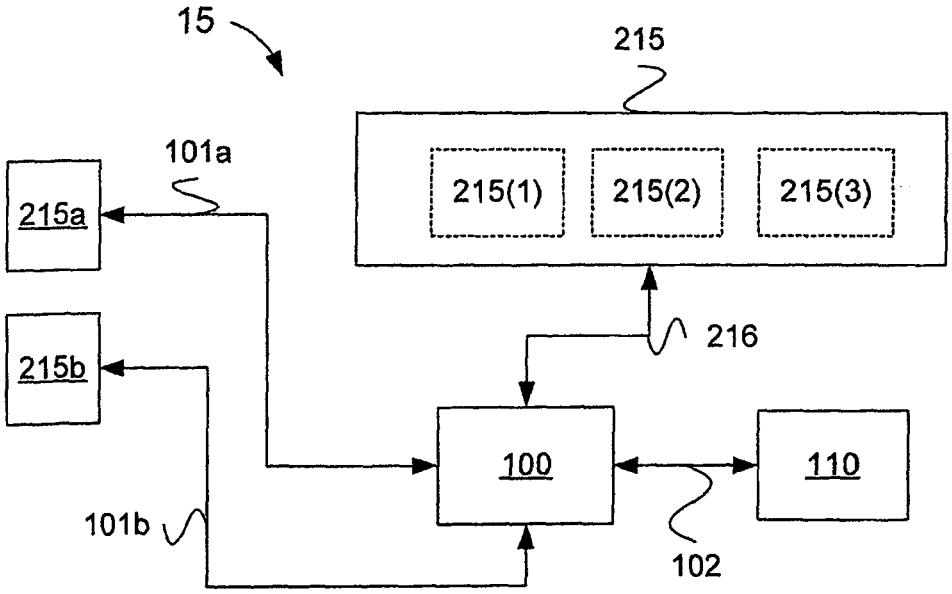
FIG. 1*b* schematically illustrates a sub-system of the platform of FIG. 1*a* according to an aspect of the present invention.

FIG. 1*b* schematically illustrates the above mentioned sub-system 15 of the platform 10. The sub-system 15 comprises a data processing unit 100. The data processing unit 100 is arranged for communication with a communication terminal 110 via a link 102. The communication terminal 110 may be a monitor, touch-screen, acoustic communication means, such as a loudspeaker, visible communication means, such as a signalling lamp, etc, or a combination thereof. The communication terminal 110 is preferably provided in a cockpit of the platform 10. The communication terminal 110 is arranged to allow an operator of the platform 10 to interact with the data processing unit 100 by means of a communications terminal 110. The communications terminal 110 is according to one embodiment of the invention provided with a suitable user interface IF.

A first sensor unit 215*a* is arranged for communication with the data processing unit 100 via a link 101*b*. A second sensor unit 215*b* is arranged for communication with the data processing unit 100 via a link 101*b*.

Also shown in FIG. 1*b* is a set of sensors 215 comprising three independent sensor units 215(1), 215(2) and 215(3). According to an embodiment of the invention the set of sensors 215 comprises an arbitrary number N of independent sensors 215(1)-215(N). The set of sensors 215 is arranged for communication with the data processing unit 100 via a link 216.

According to a preferred embodiment of the invention the sensor units 215*a*, 215*b*, 215(1), 215(2) and 215(3) are arranged to measure a hydraulic system variable. Examples of hydraulic system variables are: momentaneous pressure P [Pa] and flow [$m^3$/s] of the hydraulic fluid.

Figure 2A:
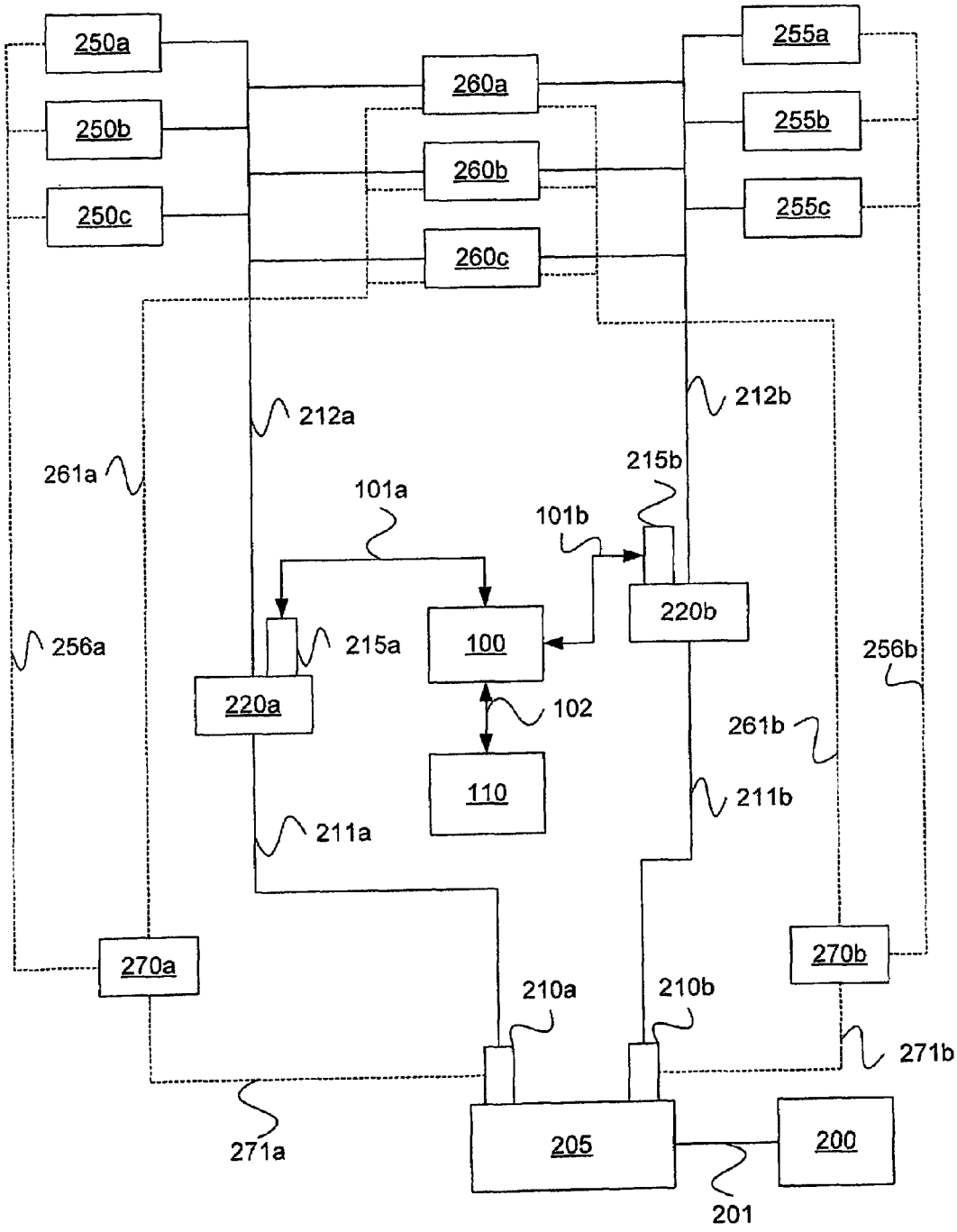
FIG. 2*a* schematically illustrates a hydraulic system of a platform according to an aspect of the present invention.

FIG. 2*a* schematically illustrates an overview of a hydraulic system provided within an aircraft 10.

An airplane engine, such as a jet engine, is denoted motor 200. The motor 200 is coupled to a gearbox 205 via a shaft 201. The gearbox 205 can be a two stage gear box, The gearbox 205 is arranged to transmit force to a first hydraulic pump 210*a*. Thus, the motor 200 is arranged to power a first hydraulic pump 210*a* via the gearbox 205.

The pump can also be attached directly to the engine.

According to one embodiment of the invention the first hydraulic pump 210*a* is for example an axial piston pump. However, any suitable hydraulic pump may be used.

The hydraulic pump 210*a* is arranged to generate a hydraulic press and flow through a first hydraulic fluid upstream pipe 21 la to a valve unit 220*a*. The valve unit 220*a* is provided with an outlet to which a second hydraulic fluid upstream pipe 212*a* is connected. The second hydraulic fluid upstream pipe 212*a* is coupled to a number of hydraulic sub-system units 250*a*, 250*b* and 250*c*. Also, the second hydraulic fluid upstream pipe 212*a* is coupled to a number of common hydraulic sub-system units 260*a*, 260*b*, and 260*c*.

The number of hydraulic sub-system units is arbitrary. For sake of simplicity there is only illustrated a fuel transfer pump 250*a*, landing gear main module 250*b* and a main brake module 250*c*. Other examples of hydraulic sub-system units are a refueling module and a steering module. The hydraulic sub-system units 250*a*, 250*b* and 250*c* are connected to a hydraulic fluid reservoir 270*a* via a hydraulic fluid downstream pipe 256*a*.

The number of common hydraulic sub-system units is arbitrary. For sake of simplicity there is only illustrated a rudder module 260*a*, left canard module 260*b*, and right canard module 260*c*. Other examples of common hydraulic sub-system units are examples of hydraulic sub-system units are a refueling module and a steering module. The common hydraulic sub-system units 260*a*, 260*b* and 260*c* are connected to the hydraulic fluid reservoir 270*a* via a hydraulic fluid downstream pipe 261*a*.

The hydraulic fluid reservoir 270*a* is coupled to the first hydraulic pump 210*a* via a reservoir pipe 271*a*.

It should be noted that the first hydraulic pump 210*a* is arranged to generate the hydraulic fluid pressure and flow through the first hydraulic fluid upstream pipe 211*a*, valve unit 220*a*, second hydraulic fluid upstream pipe 212*a*, to subsequently supply at least one hydraulic subsystem unit 250*a*, 250*b*, 250*c* and/or at least one common hydraulic sub-system unit 260*a*, 260*b*, 260*c*. Thereafter the fluid is transferred back to the first hydraulic pump 210*a* via the hydraulic fluid downstream pipe 256*a* or 261*a*, respectively, hydraulic fluid reservoir 270*a* and the reservoir pipe 271*a*. The hydraulic fluid is provided within a closed system.

A first sensor unit 215*a* is provided at the first valve unit 220*a*. The first sensor unit 215*a* is arranged to measure pressure P1*a* of the hydraulic fluid HF within the valve unit 220*a*. The first sensor unit 215*a* is arranged to measure the pressure P1*a* in a time discrete manner. The first sensor unit 215*a* arranged for communication with a data processing unit 100 via a first sensor link 101*a*. The first sensor unit 215*a* is arranged to send measured pressure data P1*a* to the processing unit 100.

The hydraulic system of the platform 10 further comprises a second sub-system. The second hydraulic sub-system comprises a second hydraulic pump 210*b*, which is powered by the motor 200 via shaft 201 and gearbox 205. The second hydraulic pump 210*b* is arranged to pump the hydraulic fluid HF2 through a first hydraulic fluid upstream pipe 211*b*, valve unit 220*b*, second hydraulic fluid upstream pipe 212*b*, to subsequently actuate at least one hydraulic subsystem unit 255*a*, 255*b*, 255*c* and/or at least one common hydraulic sub-system unit 260*a*, 260*b*, 260*c*. Thereafter the hydraulic fluid HF is transferred back to the second hydraulic pump 210*b* via a hydraulic fluid downstream pipe 256*b* or 261*b*, respectively, hydraulic fluid reservoir 270*b* and a reservoir pipe 27 lb. The hydraulic fluid is provided within a closed system. The second sensor unit 21 Sb is arranged for communication with the data processing unit 100 via a second sensor link 101*b*.

According to this embodiment the subsystem unit 255*a* is an air brake module. The subsystem unit 255*b* is a gun ventilation unit. The subsystem unit 255*c* is a landing gear module. It should be noted that the number of hydraulic subsystem units are arbitrary, depending upon e.g. type of platform and internal configuration of the same. For sake of clarity only three different examples of hydraulic subsystem units are shown herein.

The common hydraulic subsystem unit 260*a*, 260*b*, 260*c* are actuated by both the first hydraulic sub-system and the second hydraulic sub-system. According to one embodiment the first hydraulic sub-system and the second hydraulic sub-system are mutually independent, i.e. the first hydraulic fluid HF1 and the second hydraulic fluid HF2 are not mixed.

The data processing unit 100 is arranged for communication with a communications terminal 110 via a link 102. The communications terminal is depicted in greater detail with reference to FIG. 1*b*.

The data processing unit is arranged to calculate a number of stored pressure sample per unit time, e.g. minute.

Monitoring of at least one of the first and second hydraulic pumps is performed during for example flying wings-level in cruise mode, namely when the rudders in principle are nonmoving and no other activities in the hydraulic system are commanded. The monitor is in active mode during these circumstances. A normally functioning hydraulic pump is during these circumstances providing a stable pressure, where no ripple is generated. However, a malfunctioning hydraulic pump is during these circumstances generating different types of significant pressure ripple, even during flying wings-level. If pressure samples are determined to be fluctuating given a predetermined criterion, samples are stored in an internal memory of the data processing unit. The data processing unit is arranged to generate a report signal if the number of recorded pressure samples exceed a predetermined number per unit time. This makes the monitoring function according to the invention robust and simple.

Figure 2B:
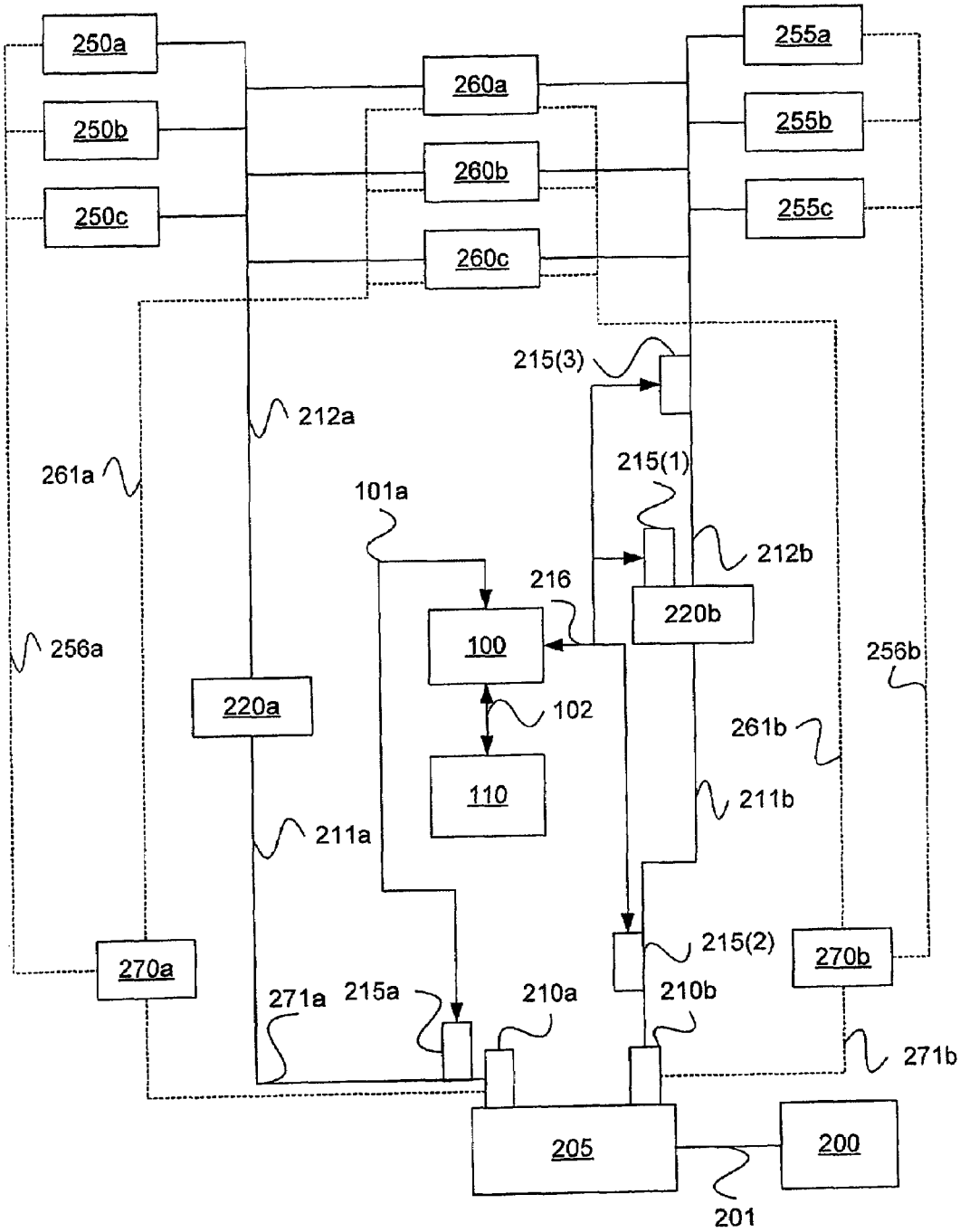
FIG. 2*b* schematically illustrates hydraulic system of a platform according to an aspect of present invention.

FIG. 2*b* schematically illustrates an overview of an alternative hydraulic system provided within an aircraft 10.

With reference to FIG. 2*b* there is illustrated that the first sensor unit 215*a* is arranged at the first hydraulic pump 210*a* instead of at the valve unit 220*a* as shown in FIG. 2*a*. The first sensor unit 215*a* is arranged to measure pressure P1*a* of the hydraulic fluid HF at an outlet of the first hydraulic pump 210*a*.

According to an alternative embodiment of the invention the first sensor unit 215*a* is arranged to measure the pressure of the hydraulic fluid HF within the second upstream pipe 212*a*. It should be noted that the hydraulic fluid HF is provided within a closed system, and therefore the first sensor unit 215*a* could be placed at various locations suitable for providing relevant pressure data P1*a* to the data processing unit 100.

According to one embodiment of the invention

Figure 3A:
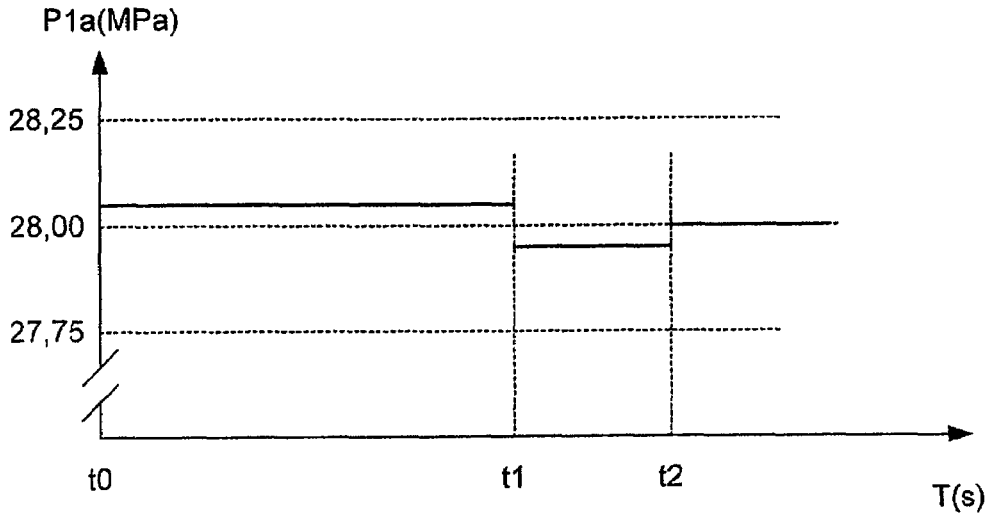
FIG. 3*a* schematically illustrates a graph according to an aspect of the present invention.
Figure 3B:
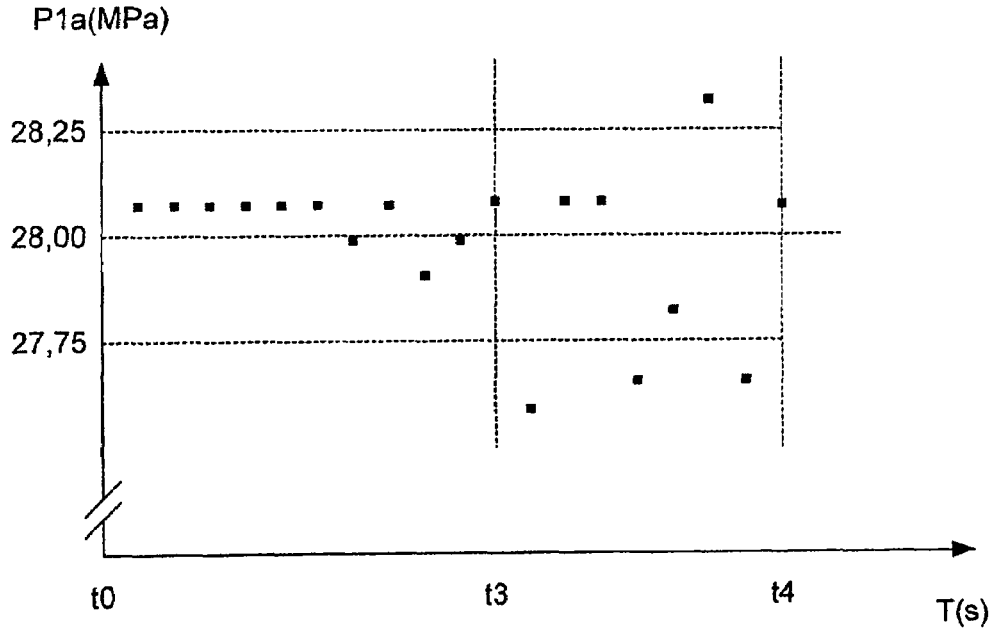
FIG. 3*b* schematically illustrates graph in more detail according to an aspect of the present invention.
Figure 3C:
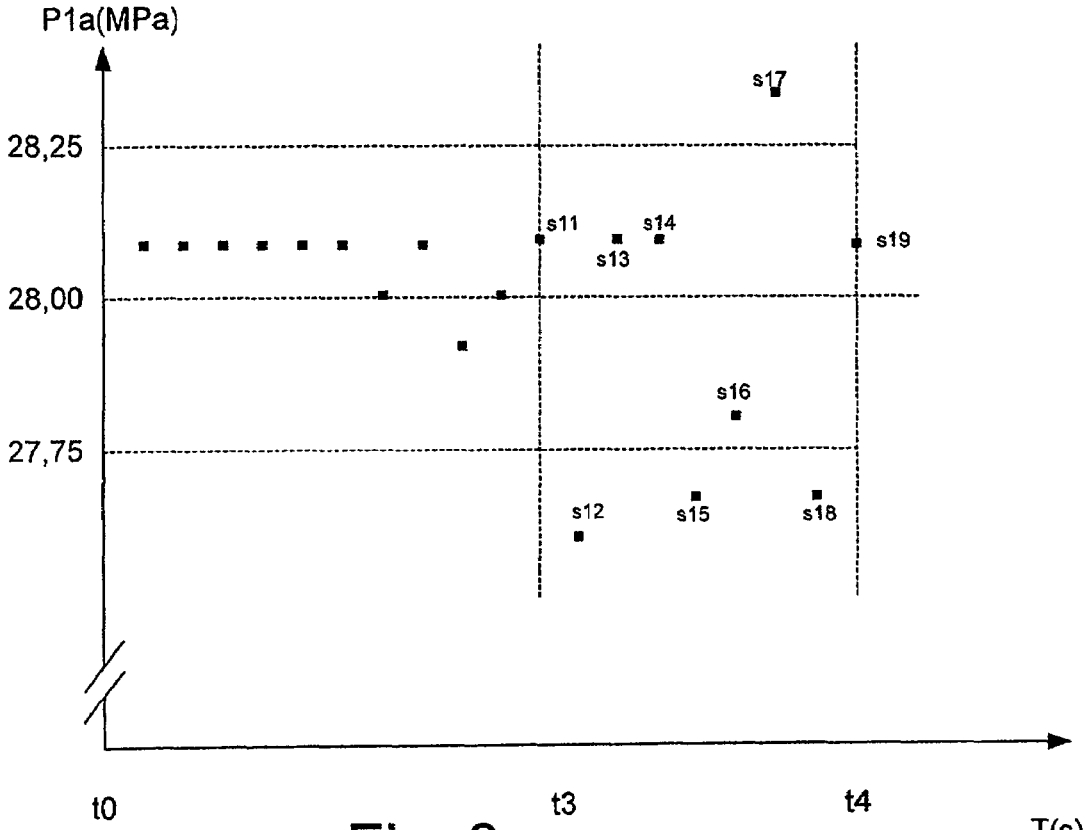
FIG. 3*c* schematically illustrates graph in more detail according to an aspect of the present invention.
Figure 6:
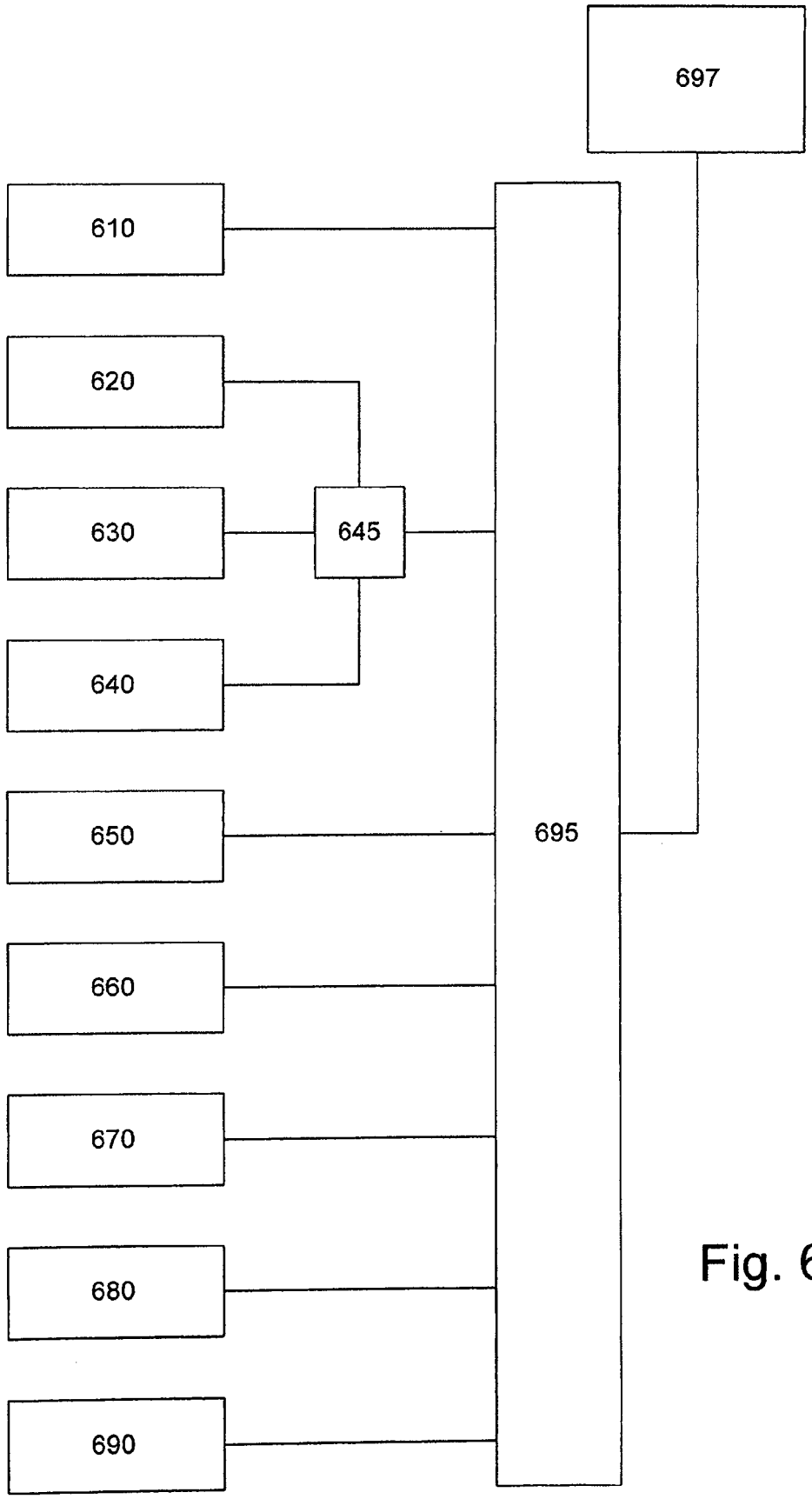
FIG. 6 schematically illustrates a logic structure depicting a stand-by state.

In FIG. 3*a*, 3*b* and 3*c* the active monitor criterion is fulfilled, which is depicted in greater detail with reference to FIG. 6.

FIG. 3*a* is a graph wherein detected hydraulic pressure P1*a* is plotted as a function of time T. Herein a should-value of the hydraulic pressure P1*a* is set for example to 28.00 MPa. A desired value of the hydraulic pressure P1*a* of the hydraulic system is thus 28.00 MPa. As can be seen the value of P1*a* is substantially 28.00 MPa during the time interval t0-t2 indicating that the first hydraulic pump 210*a* is functioning properly, i.e. no tendency of malfunctioning of the pump is indicated. The registered values of P1*a* between the time starting point t0 and the time point t1 is slightly higher than the should-value 28.00 MPa. It is also seen that registered values of P1*a* between the time point t1 and the time point t2 is slightly lower than the set value 28.00 MPa. It is also seen that registered values of P1*a* are substantially 28.00 MPa for time values larger than t2. It should be noted that registered pressure values P1*a* are within a predetermined range, namely within an interval 27.75 and 28.25 MPa. FIG. 3*a* depicts a normal state of condition of the hydraulic pump 210*a*.

FIG. 3*b* depicts in greater detail samples of measured hydraulic pressure P1*a* wherein malfunctioning of the hydraulic pump is detected within a time interval t3-t4. It is illustrated that some subsequent samples differ more than for example 0.25 MPa and is therefore indicating that the hydraulic pump 210*a* is not in a normal or desired state of condition.

FIG. 3*c* depicts in greater detail samples, for example samples s11-s19 within the time interval t3-t4, of measured hydraulic pressure P1*a* with reference to FIG. 3*b*. It is illustrated that $|s11-s12|\geq 0.25$ MPa; $|s12-s13|\geq 0.25$ MPa; $|s14-s15|\geq 0.25$ MPa;

$|s16-s17|\geq 0.25$ MPa; $|s17-s18|\geq 0.25$ MPa; $|s18-s19|\geq 0.25$ MPa.

It is also illustrated that $|s13-s14|\geq 0.25$ MPa; $|s15-s16|\geq 0.25$ MPa.

According to an aspect of the invention the number of absolute values of two subsequent pressure values, which are greater than or equal within a predetermined time interval that exceeds a predetermined threshold value, are taken into consideration when determining whether a hydraulic pump is malfunctioning or not.

In the example depicted with reference to FIG. 3*c* there are six absolute values of two subsequent pressure values which are greater than or equal 0.25 MPa within a predetermined time interval t3-t4. Also, during the predetermined time interval t3-t4 there are two absolute values of two subsequent pressure values, which are less than 0.25 MPa within the same predetermined time interval t3-t4.

By calculating the number of absolute values of two subsequent pressure values which are greater than a predetermined time period an indication value IV may be calculated. The value IV represents an indication of a condition of the monitored hydraulic pump. A high value of the indication value signifies a significant ripple of the measurements. The value IV may be expressed in pressure sample per minute.

Figure 4A:
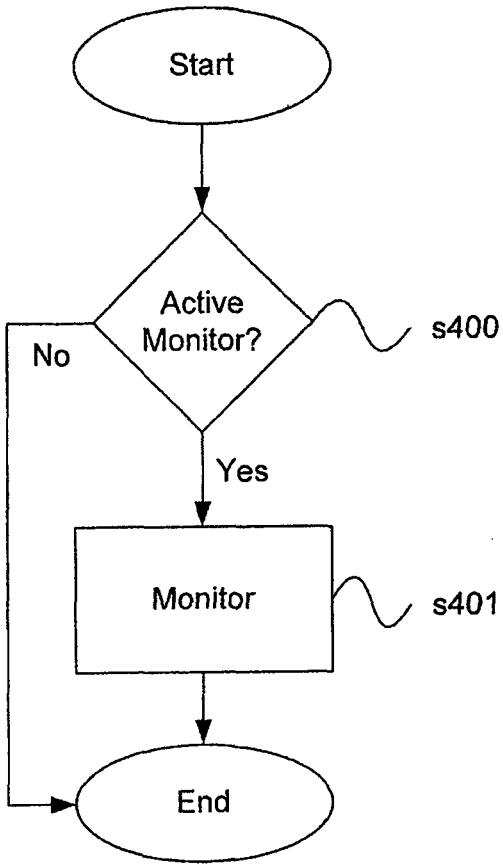
FIG. 4*a* schematically illustrates a flow chart depicting a method for monitoring a hydraulic pump according to an aspect of the present invention.

There is provided a threshold level L, which is a predetermined value. If the indication value IV exceeds the threshold level L FIG. 4*a* schematically illustrates a method for monitoring a hydraulic pump within a platform. The method comprises two steps. The first step s400 comprises the step of determining whether a state of active monitoring is set. If the state of active monitoring is provided, a second step s401 is performed. If the state of active monitoring is not provided the method ends.

The second step s400 comprises the sub-steps of:

determining whether the active monitor criterion is fulfilled;

generating sample values relating to a hydraulic fluid characteristic variable, wherein said fluid is fed by the hydraulic pump within the platform;

receiving a plurality of sample values from said sensor means;

generating an absolute value of a difference between each of said received plurality of sample values and a subsequent associated sample value, wherein said received sample values are generated during a predetermined time period;

determining an indication number corresponding to the number of said generated absolute values which are greater than a predetermined threshold value; and generating a piece of indication information depending upon a result of a comparison between said determined indication number and a predetermined comparison value.

The predetermined value is preferably a threshold value. The threshold value depends on the system characteristic. The thresholds can be multiple.

Monitor is active when a criterion comprising a stable pump in a no load condition and all hydraulic consumers are in a resting position or close to a resting position is fulfilled. Hydraulic consumers can be hydraulic valves for surface actuating, landing gear maneuvering or air brakes.

After the method step s401 the method ends.

Preferably the method comprises the step of:

generating sample values relating to a hydraulic fluid characteristic variable, wherein the fluid characteristic variable is a hydraulic fluid characteristic variable chosen from a group comprising hydraulic fluid pressure and a hydraulic fluid flow.

Preferably the method comprises the step of:

storing the piece of indication information in a memory so as to allow a user to access said indication information.

Preferably the method comprises the step of:

generating a fault report after a predetermined time or substantially instantaneous depending upon a result of the comparison between said determined indication number and a predetermined comparison value.

Figure 4B:
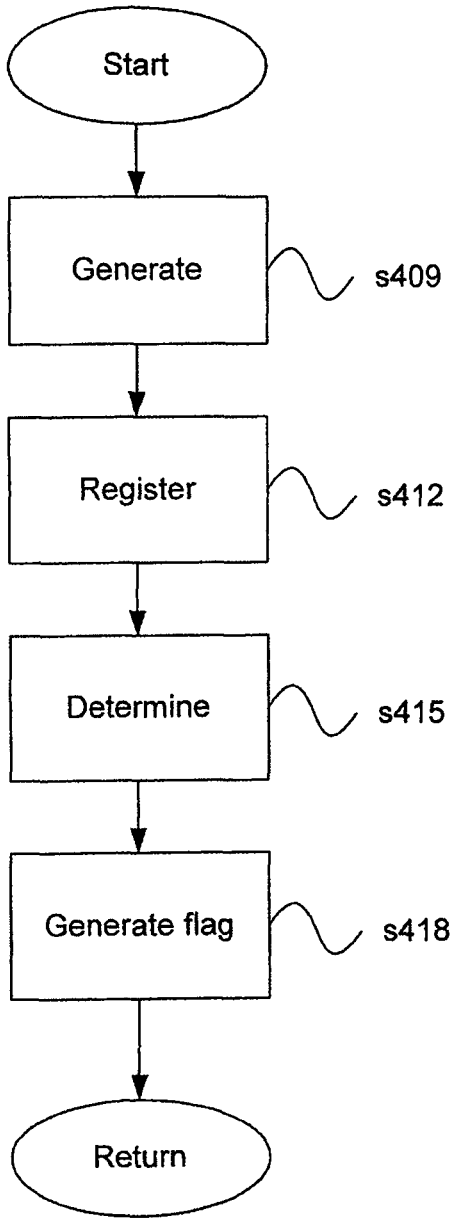
FIG. 4*b* schematically illustrates in greater detail a flow chart depicting a method monitoring a hydraulic pump according to an aspect of the present invention.

FIG. 4*b* schematically illustrates in greater detail a method for early detection of faults of a hydraulic pump onboard a platform.

The method comprises a first method step s409. The method step s409 comprises the steps of:

continuously generating samples of hydraulic fluid variable which is indicative of a hydraulic pump status condition, wherein the hydraulic fluid variable for example is a hydraulic fluid pressure;

sending said generated samples to a processing means. After the method step s409 a subsequent method step s412 is performed.

The method step s412 comprises the steps of:

receiving said generated samples;

register at least some samples according to a predetermined criterion. After the method step s412 a subsequent method step s415 is performed.

The method step s41 5 comprises the step of:

determining a number of received sample values which fulfil a predetermined criterion. The received sample values are belonging to a time period when the monitor is active, for example 10 minutes during taxiing on ground, or 5 minutes during idling of the platform. The monitor can be active for several times during a flight. An example of the predetermined criterion is that a sample value is counted if it deviates from a set value, for example 28 MPa, more than an aperture value (for example 0.25 MPa). According to another embodiment a sample value is only counted if an absolute value of the difference between the sample value of interest and a subsequent sample value differs more than a threshold value.

After the method step s415 a subsequent method step s418 is performed. The method step s418 comprises the steps of: generating at least one flag. The process of determining levels for setting monitoring flags is based on the process of filtering a pressure signal and aperture limits. The aperture is in turn adapted to a characteristic of a hydraulic pump, so that changes of pressure measurements, while the system is in stand-by state, or in idle state, do not give rise to pressure samples which are counted by the monitor.

Also, the process of determining levels for setting monitoring flags is based on the characteristics of the pump in stand-by region, i.e. when the necessary flow of fluid is low, e.g. in the case of an airplane, only a few litres/minute. Thereafter the method ends.

Figure 5:
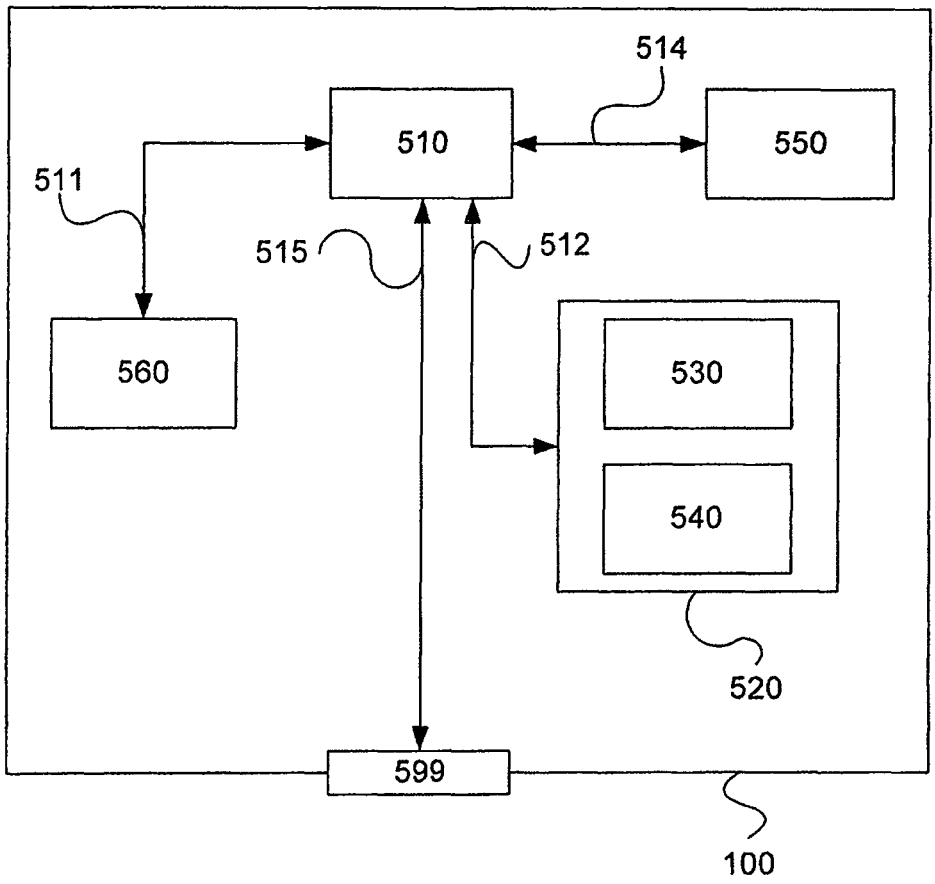
FIG. 5 schematically illustrates a data processing unit according to an aspect of the invention.

With reference to FIG. 5, a diagram of one embodiment of the apparatus 100 is shown. Apparatus 100 comprises a non-volatile memory 520, a data processing device 510 and a read/write memory 550. Non-volatile memory 520 has a first memory portion 530 wherein a computer program, such as an operating system, is stored for controlling the function of apparatus 100. Further, apparatus 100 comprises a bus controller, a serial communication port, I/O-means, an A/D-converter, a time date entry and transmission unit, an event counter and an interrupt controller (not shown). Non-volatile memory 520 also has a second memory portion 540.

A computer program comprising routines for monitoring of a hydraulic pump onboard a platform, which data is generated by sensors units according to the invention. The program may be stored in an executable manner or in a compressed state in a separate memory 560 and/or in read/write memory 550.

When it is stated that data processing device 510 performs a certain function it should be understood that data processing device 510 performs a certain part of the program which is stored in separate memory 560, or a certain part of the program which is stored in read/write memory 550.

Data processing device 510 may communicate with a data port 599 by means of a data bus 515. Non-volatile memory 520 is adapted for communication with data processing device 510 via a data bus 512. Separate memory 560 is adapted to communicate with data processing device 510 via a data bus 511. Read/write memory 550 is adapted to communicate with data processing device 510 via a data bus 514.

When data is received on data port 599 it is temporarily stored in second memory portion 540. When the received input data has been temporarily stored, data processing device 510 is set up to perform execution of code in a manner described above. According to one embodiment, data received on data port 599 comprises information such as input signals provided by the sensors 215*a*, 215*b* or the set of sensors 215. This information can be used by apparatus 100 so as to identify if a hydraulic pump onboard the platform is malfunctioning.

Parts of the methods described herein can be performed by apparatus 100 by means of data processing device 510 running the program stored in separate memory 560 or read/write memory 550. When apparatus 100 runs the program, parts of the methods described herein are executed.

An aspect of the invention relates to a computer programme comprising a programme code for performing the method steps depicted with reference to FIG. 4*a* and 4*b*, respectively, when the computer programme is run on a computer.

An aspect of the invention relates to a computer programme product comprising a program code stored on computer-readable media for performing the method steps depicted with reference to FIG. 4*a* and 4*b*, respectively, when the computer programme is run on the computer.

An aspect of the invention relates to a computer programme product directly storable in an internal memory of a computer, comprising a computer programme for performing the method steps depicted with reference to FIG. 4*a* and 4*b*, respectively, when the computer programme is run on the computer.

FIG. 6 schematically illustrates a logic structure depicting a stand-by state configuration according to an embodiment of the invention.

A unit 610 represents a condition where a derivative of a commanded control of at least one control surface is strictly less than a predetermined number of degrees/seconds during a predetermined time period.

A unit 620 represents a condition of, during operational phase: Flying with landing gear retracted.

A unit 630 represents a condition of, during operational phase: Parked airplane with a running engine.

A unit 640 represents a condition of, during operational phase: Taxation of the airplane.

A unit 650 represents a condition of not commanding air brakes.

A unit 660 represents a condition of not commanding High Lift System/Leading Edge Flap System.

A unit 670 represents a condition of not commanding hydraulic supplied fuel transfer pump(s), if at least one control signal is provided on relevant data bus.

A unit 680 represents a condition of not commanding remaining hydraulic sub systems, if at least one control signal is provided on relevant data bus.

A unit 690 represents a condition where no warning flags from control- or hydraulic system affecting stand by-/idle position are provided.

The unit 645 is an "OR"-functioning unit, such as an OR-gate.

The unit 695 is an "AND"-functioning unit, such as an AND-gate.

Thus, if at least one condition associated with the units 620, 630 or 640 is true this condition is provided to the unit 695 via the unit 645. If all conditions associated with the units 610, 645, 650, 660, 670, 680, and 690 hold true a state of active monitoring also holds true (unit 697). If a condition of active monitoring associated with the unit 697 holds true this means that the hydraulic pump is in stand-by or idle position.

It should be noted that various forms the logic structure depicting a stand-by state configuration may be implemented.

The scope of the invention is not limited to hydraulic fluid systems, other applications includes fuel systems and cooling systems. It should be noted that the method according to the invention also is applicable to fluid systems, i.e. systems which involve e.g. water.

The foregoing description of the preferred embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated.

The invention claimed is:

1. An arrangement for monitoring a hydraulic pump within a platform, the arrangement comprising:

a sensor arranged to generate sample values relating to a fluid characteristic variable, wherein a fluid is fed by the hydraulic pump within the platform; and a processor arranged to receive a plurality of the sample values from said sensor, wherein the processor is arranged to generate an absolute value of a difference between each of said received plurality of sample values and a subsequent associated sample value, wherein said received sample values are generated during a predetermined time period, and wherein the processor is arranged to determine an indication number corresponding to a number of said generated absolute values during the predetermined time period which are greater than a predetermined threshold value, wherein the processor is arranged to generate a piece of indication information depending upon a result of a comparison between said determined indication number and a predetermined comparison value, wherein the fluid characteristic variable comprises hydraulic fluid flow, and wherein the difference between each of said received plurality of sample values and the subsequent associated sample value is the difference between two directly successive sample values.

2. The arrangement according to claim 1, wherein the fluid comprises a media chosen from a group comprising oil and water.

3. The arrangement according to claim 1, wherein the processor is arranged to store the piece of indication information in a memory so as to allow a user to access said indication information.

4. The arrangement according to claim 1, wherein the piece of indication information comprises information about a state of condition of said hydraulic pump.

5. The arrangement according to claim 4, wherein the information about a state of condition comprises information about whether the hydraulic pump is malfunctioning.

6. The arrangement according to claim 1, further comprising:

an indicator arranged to generate a fault report after a predetermined time or substantially instantaneous depending upon a result of the comparison between said determined indication number and the predetermined comparison value.

7. The arrangement according to claim 1, wherein the fluid comprises a hydraulic oil.

8. A platform, comprising an arrangement for monitoring a hydraulic pump within a platform, the arrangement comprising:

a sensor arranged to generate sample values relating to a fluid characteristic variable, wherein a fluid is fed by the hydraulic pump within the platform, and a processor arranged to receive a plurality of the sample values from said sensor, wherein the processor is arranged to generate an absolute value of a difference between each of said received plurality of sample values and a subsequent associated sample value, wherein said received sample values are generated during a predetermined time period, and wherein the processor is arranged to determine an indication number corresponding to a number of said generated absolute values during the predetermined time period which are greater than a predetermined threshold value, and wherein the processor is arranged to generate a piece of indication information depending upon a result of a comparison between said determined indication number and a predetermined comparison value, wherein the fluid characteristic variable comprises hydraulic fluid flow, and wherein the difference between each of said received plurality of sample values and the subsequent associated sample value is the difference between two directly successive sample values.

9. The platform according to claim 8 wherein the platform comprises a mobile platform chosen from a group comprising an aircraft, ground vehicle, water craft or underwater craft.

10. The platform according to claim 8, wherein the platform comprises a stationary platform.

11. The platform according to claim 8, wherein the platform comprises a mobile platform selected from the group comprising an airplane, automobile, ship or submarine.

12. The platform according to claim 8, wherein the platform comprises a pulp machine or steel press.

13. A method for monitoring a hydraulic pump within a platform, the method comprising:

generating sample values relating to a hydraulic fluid characteristic variable, wherein the fluid characteristic variable comprises hydraulic fluid flow, and wherein a fluid is fed by the hydraulic pump within the platform;

receiving the plurality of sample values from a sensor, generating an absolute value of a difference between each of said received plurality of sample values and a subsequent associated sample value, wherein said received sample values are generated during an active monitor period, and wherein the difference between each of said received plurality of sample values and the subsequent associated sample value is the difference between two directly successive sample values, determining an indication number corresponding to a number of said generated absolute values during the active monitor period which are greater than a predetermined threshold value, and generating a piece of indication information depending upon a result of a comparison between said determined indication number and a predetermined value.

14. The method according to claim 13, further comprising:

storing the piece of indication information in a memory so as to allow a user to access said indication information.

15. The method according to claim 13, further comprising:

generating a fault report after a predetermined time or substantially instantaneous depending upon a result of the comparison between said determined indication number and a predetermined threshold value.

16. A computer program product, comprising a non-transitory computer readable medium; and computer program instructions recorded on the computer readable medium and executable by a processor for performing a method for monitoring a hydraulic pump within a platform, the method comprising:

generating sample values relating to a hydraulic fluid characteristic variable, wherein the fluid characteristic variable comprises hydraulic fluid flow, and wherein a fluid is fed by the hydraulic pump within the platform;

receiving a plurality of the sample values from a sensor, generating an absolute value of a difference between each of said received plurality of sample values and a subsequent associated sample value, wherein said received sample values are generated during an active monitor period, and wherein the difference between each of said received plurality of sample values and the subsequent associated sample value is the difference between two directly successive sample values, determining an indication number corresponding to a number of said generated absolute values during the active monitor period which are greater than a predetermined threshold value, and generating a piece of indication information depending upon a result of a comparison between said determined indication number and a predetermined value.

* * * * *